US007195452B2

(12) United States Patent
Allan et al.

(10) Patent No.: US 7,195,452 B2
(45) Date of Patent: Mar. 27, 2007

(54) COMPLIANT MOUNTING SYSTEM FOR TURBINE SHROUDS

(75) Inventors: Adrian R. Allan, Phoenix, AZ (US); James L. Hadder, Scottsdale, AZ (US); George E. Zurmehly, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 264 days.

(21) Appl. No.: 10/950,750

(22) Filed: Sep. 27, 2004

(65) Prior Publication Data

US 2006/0067813 A1 Mar. 30, 2006

(51) Int. Cl.
*F01D 11/08* (2006.01)
*F01D 25/26* (2006.01)

(52) U.S. Cl. ..... 415/135; 415/318; 415/173.3; 415/213.1; 415/214.1; 29/446; 29/452; 29/889.2; 29/889.22; 248/675

(58) Field of Classification Search ..... 415/135, 415/136, 138, 139, 173.1, 173.3, 213.1, 214.1; 29/446, 452, 889.2, 889.21, 889.22; 24/289, 24/292–293; 248/674–675; 267/158–160
See application file for complete search history.

(56) References Cited

U.S. PATENT DOCUMENTS

| | | | | |
|---|---|---|---|---|
| 2,777,032 | A * | 1/1957 | Burch | 267/159 |
| 3,196,233 | A * | 7/1965 | Parkhurst et al. | 337/94 |
| 3,966,356 | A | 6/1976 | Irwin | |
| 4,087,199 | A | 5/1978 | Hemsworth et al. | |
| 4,278,855 | A * | 7/1981 | Rossi | 29/446 |
| 4,332,523 | A | 6/1982 | Smith | |
| 4,796,355 | A * | 1/1989 | Burch et al. | 29/446 |
| 5,080,557 | A | 1/1992 | Berger | |
| 5,181,826 | A | 1/1993 | Rock | |
| 5,181,827 | A | 1/1993 | Pellow et al. | |
| 5,330,321 | A | 7/1994 | Roberts et al. | |
| 5,846,050 | A * | 12/1998 | Schilling | 415/135 |
| 5,868,398 | A * | 2/1999 | Maier et al. | 415/135 |
| 6,142,731 | A | 11/2000 | Dewis et al. | |
| 6,315,519 | B1 | 11/2001 | Bagepalli et al. | |
| 6,368,054 | B1 | 4/2002 | Lucas | |
| 6,406,256 | B1 | 6/2002 | Marx | |
| 6,480,090 | B1 * | 11/2002 | Wang | 337/59 |
| 2002/0071762 | A1 | 6/2002 | Schroder | |
| 2002/0192074 | A1 | 12/2002 | Turnquist et al. | |
| 2003/0202876 | A1 | 10/2003 | Jasklowski et al. | |
| 2003/0215328 | A1 | 11/2003 | McGrath et al. | |
| 2004/0005216 | A1 | 1/2004 | Suzumura | |

FOREIGN PATENT DOCUMENTS

| | | | |
|---|---|---|---|
| GB | 2129880 | | 5/1984 |
| JP | 60-125429 | A * | 7/1985 |

* cited by examiner

*Primary Examiner*—Christopher Verdier
(74) *Attorney, Agent, or Firm*—Ingrassia Fisher & Lorenz

(57) ABSTRACT

The mounting of low expansion full ring shrouds in a turbine engine requires radial compliance to limit the stresses experienced by the shroud due to thermal growth differences between the shroud and its support. A method provides radial compliance with no looseness in a mounting system. The mounting system also allows for axial motion of the shroud, should such motion be needed or desired. The lack of looseness in the mounting system results in an ability to achieve smaller tip clearances and thus better engine performance.

22 Claims, 3 Drawing Sheets

COMPLIANT MOUNTING SYSTEM FOR TURBINE SHROUDS

GOVERNMENT RIGHTS

This invention was made with Government support under Contract Number DAAH10-03-2-0007 awarded by the United States Army. The Government has certain rights in this invention.

BACKGROUND OF THE INVENTION

The present invention generally relates to a mounting system for a turbine shroud and, more specifically, to a mounting system for a turbine shroud that provides radial compliance while minimizing looseness in the mounting system. The present invention also relates to methods for mounting a turbine shroud in a gas turbine engine.

Axial flow compressor or turbine rotor blade stages in gas turbine engines may be provided with shroud rings for the purpose of maintaining clearances between the tips of the rotor blades and the shrouds over as wide a range of rotor speeds and temperatures as possible. Blade tip clearances or clearance gaps that are too large reduce the efficiency of the compressor or turbine while clearances which are too small may cause damage under some conditions due to interference between the blade tips and the shroud ring.

The use of solid ring shrouds is common in gas turbines, but all of these applications must allow for thermal growth differences between the shroud and the engine case structure. In many applications this is accomplished by a rigid connection to the engine case with the flexibility of the shroud providing compliance. This generates stress and distortion in the shroud that is not desirable and may result in larger than desired tip gaps to prevent the blade tips from contacting the shroud. In other solid ring shroud applications thermal growth differences are accommodated by the use of a radially guided attachment. This method of attachment provides slots on the case and pins or tangs on the shroud arranged such that the shroud may grow relative to the case without building stresses. This type of arrangement must allow some clearance between the slots and pins or tangs to account for manufacturing tolerances and thermal growth of the slot and pin features. These clearances result in the shroud being loose in the case when assembled and reduces the ability to align the shroud to the center of blade tip rotation.

In gas turbine engines a tip clearance gap has to exist in order that the rotor blade tips keep clear of the shrouds under various operating conditions. It is usual to adopt a compromise whereby the tip clearance is large enough to avoid contact between the rotor blade tips and the shrouds but is made as small as possible for maximum efficiency. The positional accuracy of the inner surface of the shroud, relative to the blade tips is one of the variables that must be taken into account when making this compromise.

U.S. Patent Publication Number 2003-0202876 discloses a full ring low expansion ceramic to control the tip gap in a turbine shroud. As disclosed in the '876 publication, springs may be used to provide compliance for radial thermal growth and position control. By using a single spring of uniform stiffness, however, pins may be required to provide a positive stop, which, in many cases, may not provide the needed positioning control. The '876 publication uses three flats to prevent rotation in the event of a shroud rub. While these flats may impart local radial forces at three locations during a shroud rub, these forces may be insufficient to fully prevent rotation in the event of a shroud rub at higher shroud torque loads. Finally, the shroud of the '876 publication is axially positioned by two metallic radial plates with one edge exposed to the hot flow path. These plates may need to be slotted and cooled to prevent distortion and burning, resulting in additional machining time and expense.

As can be seen, there is a need for an improved mounting system for turbine shrouds and methods that provides radial compliance to limit the stresses experiences by the shroud due to thermal growth differences. Moreover, there is a need for an improved mounting system for turbine shrouds and methods that provide positional certainty during assembly, thereby avoiding the need for further tip clearances due to looseness during assembly.

SUMMARY OF THE INVENTION

In one aspect of the present invention, a flexure assembly comprises a base; a first arm extending from a first side of the base and running adjacent to and spaced from a bottom of the base; a second arm extending from a second, opposite side of the base and running adjacent to and spaced from the bottom of the base; ends of the first arm and the second arm defining a space therebetween; and a spring affixed to a surface of the base, wherein the spring is capable of providing a first resilient force to an object in the space; wherein the first arm and the second arm are capable of providing a second resilient force to an object in the space.

In another aspect of the present invention, a mounting system for attaching a first part to a second part comprises at least three tabs on the first part; at least three flexure assemblies attachable to the second part, the flexure assembly comprising a base, a first arm extending from a first side and running adjacent to and spaced from a bottom of the base, a second arm extending from a second, opposite side and running adjacent to and spaced from the bottom of the base, ends of the first arm and the second arm having a space therebetween, and a spring fixed to a surface of the base; wherein when the tab is placed in the space, the spring provides a resilient force to the tab; and wherein when the tab is placed in the space, the first arm and the second arm provide a resilient force to a first side and a second side of the tab.

In yet another aspect of the present invention, shroud mounting system for attaching a turbine shroud to an engine casing comprises at least three tabs on the outer circumference of the turbine shroud; at least three flexure assemblies attachable to the engine casing, each flexure assembly comprising a base, a first arm extending from a first side of the base and running parallel to a bottom of the base, a second arm extending from a second, opposite side of the base and running parallel to the bottom of the base, ends of the first arm and the second arm defining a space therebetween, and a spring affixed to a surface of the base; wherein when the tab is placed in the space, the spring provides a resilient force to the tab; and wherein when the tab is placed in the space, the first arm and the second arm are capable of providing a resilient force to a first side and a second side of the tab.

In a further aspect of the present invention, a shroud mounting system for attaching a turbine shroud to an engine casing of a gas turbine engine comprises at least three tabs equally spaced about a circumference of the turbine shroud; at least three flexure assemblies attachable to the engine casing, the flexure assembly comprising a base, a first arm formed integrally with and extending from a first side of the base and running parallel to a bottom of the base, a second arm formed integrally with and extending from a second, opposite side of the base and running parallel to the bottom of the base, ends of the first arm and the second arm having a space therebetween, and a spring affixed to a surface of the base, each of the flexure assemblies adapted for attachment to a corresponding one of the tabs; a flexure formed in the base, wherein the flexure permits the first arm to resiliently bend away from the tab along a longitudinal axis of the first assembly arm; at least one bore in the base, the bore adapted for affixing the flexure assembly to the engine casing; and a radial space formed between the bottom of the base and a top of each of the first arm and the second arm, the radial space permitting radial movement of the shroud relative to the engine casing; wherein when the tab is placed in the space, the spring provides a resilient force to the tab; and wherein when the tab is placed in the space, the first arm and the second arm provide a resilient force to a first side and a second side of the tab.

In still a further aspect of the present invention, a method for attaching a turbine shroud to an engine casing of a gas turbine engine comprises attaching at least three flexure assemblies to the engine casing, each flexure assembly comprising a base, a first arm formed integrally with and extending from a first side of the base and running parallel to a bottom of the base, a second arm formed integrally with and extending from a second, opposite side of the base and running parallel to the bottom of the base, ends of the first arm and the second arm having a space therebetween, and a spring affixed to a surface of the base; providing at least three tabs equally spaced about a circumference of the turbine shroud; positioning each of the tabs between the end of the first arm and the end of the second arm of each of the flexure assemblies; and affixing the base to the engine casing.

In still another aspect of the present invention, a method for allowing differential radial thermal expansion between an engine casing and a turbine shroud attached thereto, comprises attaching at least three flexure assemblies to the engine casing, the flexure assembly comprising a base, a first arm formed integrally with and extending from a first side of the base and running adjacent to and spaced from a bottom of the base, a second arm formed integrally with and extending from a second, opposite side of the base and running adjacent to and spaced from the bottom of the base, ends of the first arm and the second arm having a space therebetween, and a spring affixed to a surface of the base; and positioning each of at least three tabs extending radially from the circumference of the shroud between the end of the first arm and the end of the second arm of each of the flexure assemblies.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides a compliant mounting system for a component, such as a turbine shroud, and a method for mounting a component, such as a turbine shroud onto a second component, such as a gas turbine engine. The mounting of full ring shrouds in a turbine engine requires radial compliance to limit the stresses experienced by the shroud due to thermal growth differences between the shroud and its support. In commonly used mounting systems, positional uncertainty, or looseness, due to dimensional tolerances required to assemble the shroud may result in additional tip clearances and thus lower engine performance. Unlike conventional mounting systems, the present invention uses a flexure assembly, as described in more detail below, that provides a resilient force to a tab on the shroud to minimize looseness in mounting the shroud in the turbine engine.

The present invention further provides a method of providing radial compliance with no looseness in the mounting system. The compliant mounting system of the present invention allows for axial motion of the shroud, should such motion be needed or desired. Unlike conventional shroud mounting systems, the lack of looseness in the shroud mounting system of the present invention may result in an ability to achieve smaller blade tip/shroud ring clearances and thus better engine performance. The design of the mounting system of the present invention also allows the shroud to be positioned at assembly, unlike conventional mounting systems, wherein slop, or looseness, in the assembly may result in inadequate positioning of the shroud assembly on the engine casing.

The present invention further provides a method of providing an anti-rotation capability to prohibit the shroud from spinning if contact between the blade tip and shroud should occur.

Figure 1:
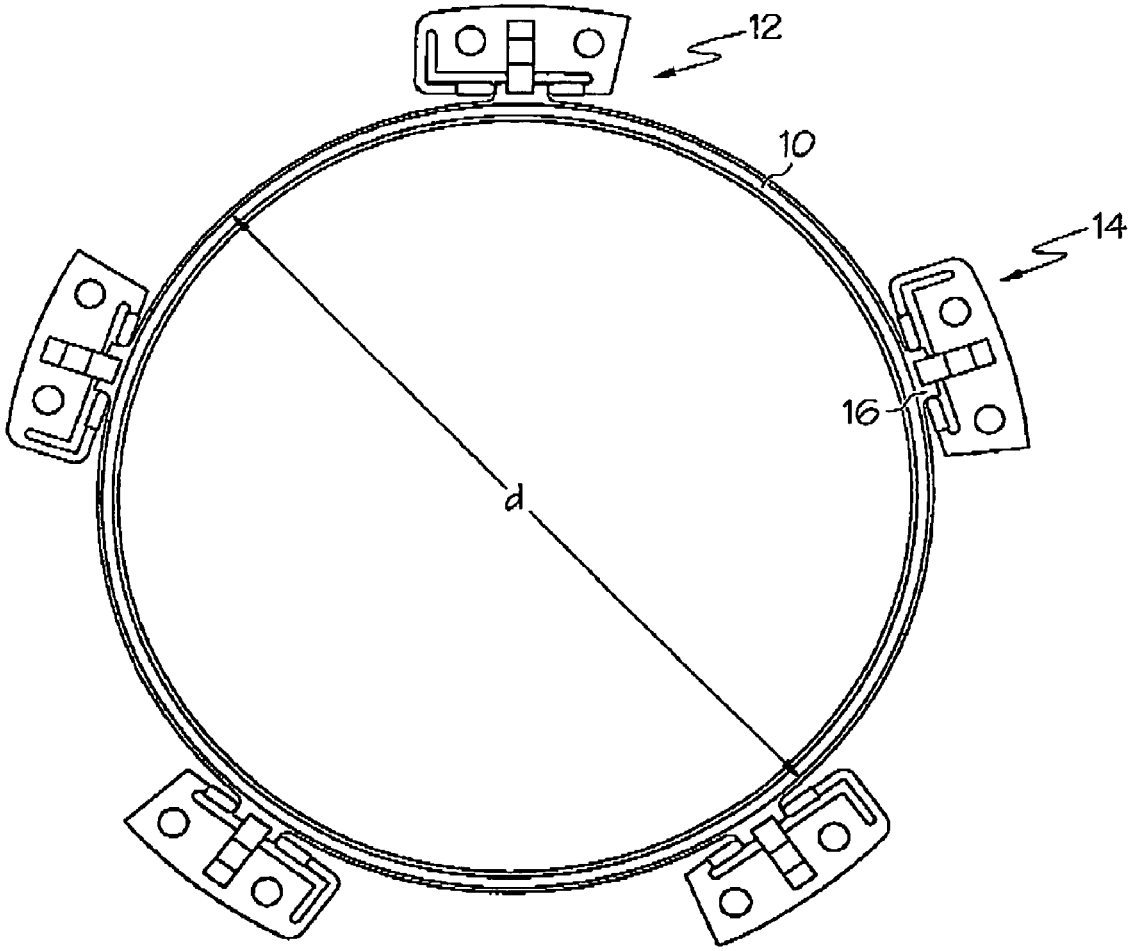
FIG. 1 is a front view showing one embodiment of a shroud in a shroud mounting system according to the present invention.

Referring to FIG. 1, there is shown a front view of a shroud 10 in a shroud mounting system 12 according to one embodiment of the present invention. Shroud mounting system 12 may include a flexure assembly 14 flexibly attached to tabs 16 of shroud 10. While the embodiment of FIG. 1 shows five flexure assemblies 14 attached to tabs 16 equally spaced about the circumference of shroud 10, the invention is not so limited. As one skilled in the art can appreciate, at least three flexure assemblies 14 may be used to provide adequate support for shroud 10. What defines adequate support may depend on, among other things, the diameter of shroud 10 and the amount of support needed to securely mount shroud 10 in the gas turbine engine (not shown). By means of example, as shown in FIG. 1, five flexure assemblies may provide adequate support for a shroud having a diameter, d, of about six inches. In one embodiment of the present invention, adequate support may be achieved by equally spacing flexure assemblies 14 about shroud 10.

Figure 2:
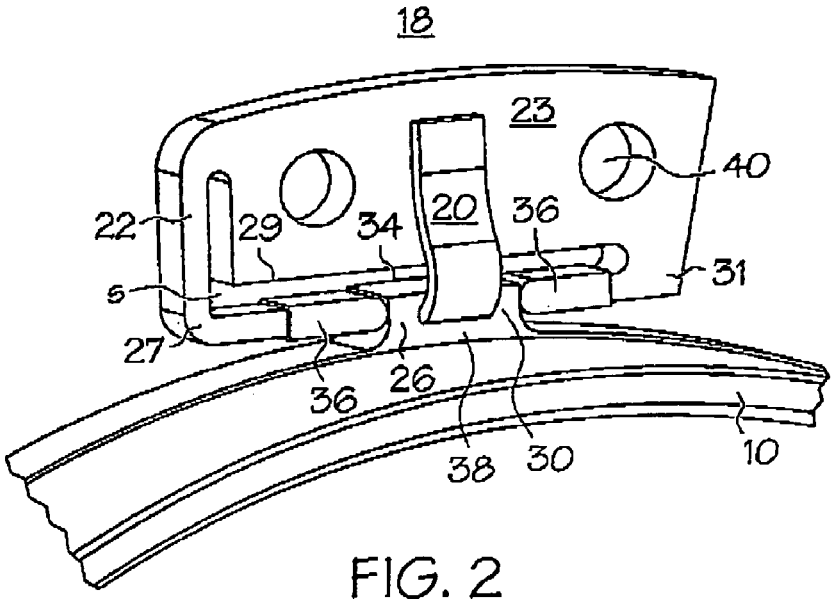
FIG. 2 is a close-up isometric view of the shroud mounting system of FIG. 1.
Figure 3:
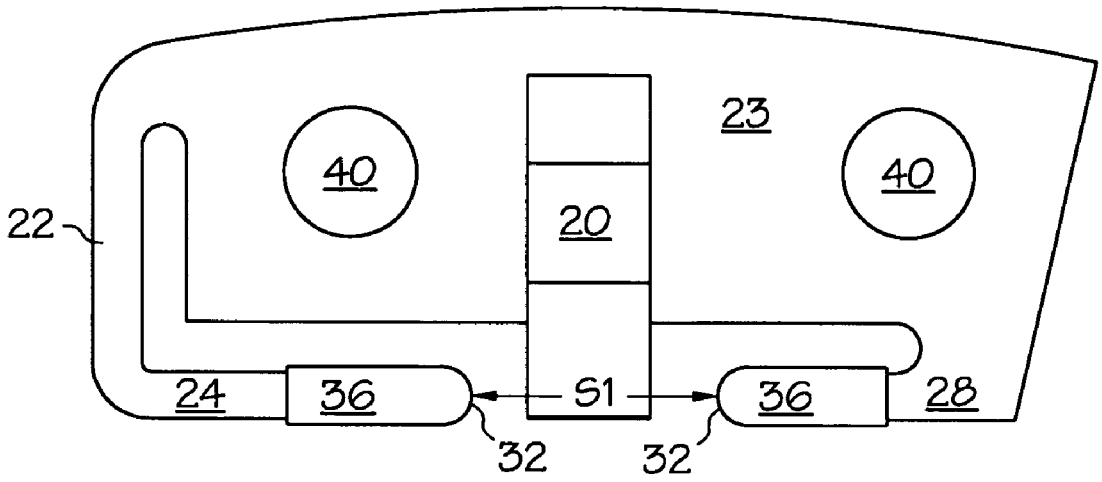
FIG. 3 is a front view of a flexure assembly for use in the shroud mounting system of the present invention.
Figure 4:
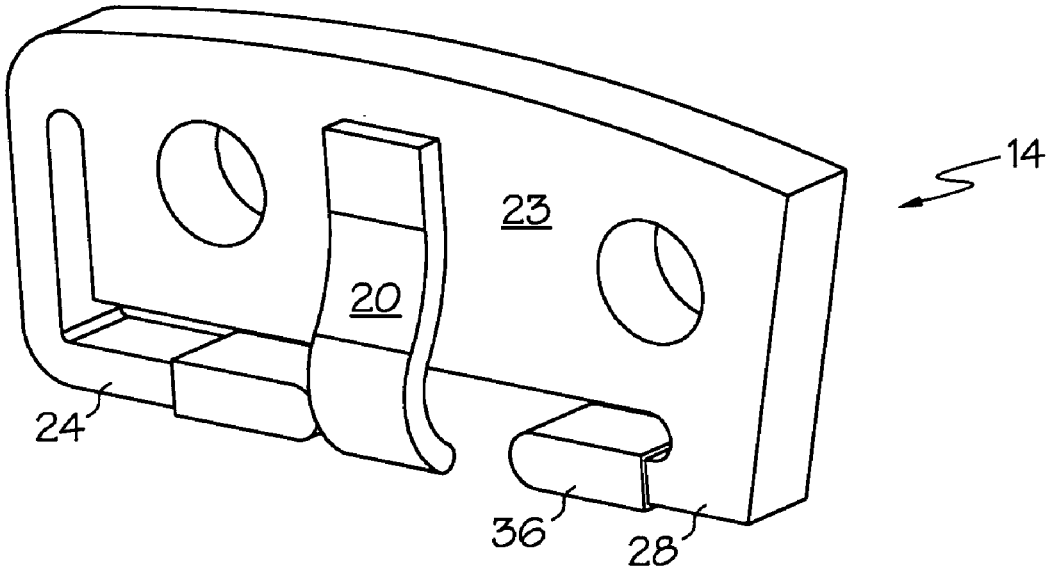
FIG. 4 is an isometric view of the flexure assembly of FIG. 3.
Figure 5:
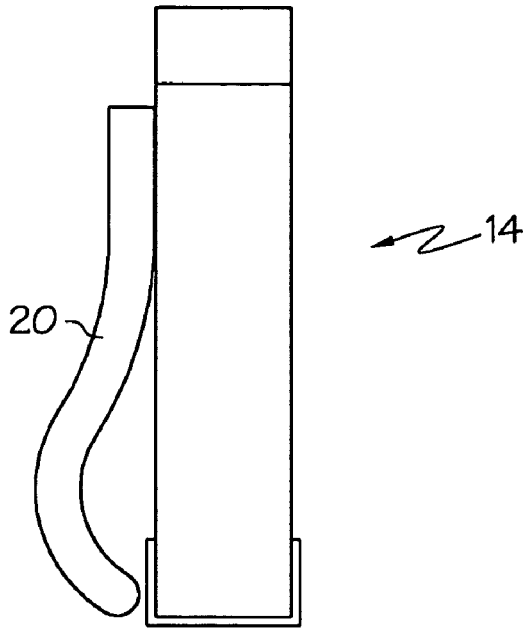
FIG. 5 is a right side view of the flexure assembly of FIG. 3.

Referring now to FIGS. 2–5, there are shown close-up views of flexure assembly 14 attached to shroud 10 (FIG. 2) and separated from shroud 10 (FIGS. 3–5). As described in more detail below, each flexure assembly 14 may act as multi-positional springs to connect shroud 10 to the engine casing, shown generally as numeral 18. Flexure assembly 14 may provide a low stiffness in one direction, but high stiffness in other directions.

A spring 20 may be affixed to base 23 of flexure assembly 14. When assembled as shown in FIG. 2, spring 20 may provide axial support to shroud 10 by resiliently contacting an object, such as a front surface 38 of tab 16. Spring 20 may allow for movement of shroud 10 in the axial direction, should such movement be needed or desired.

A flexure 22 may be provided in flexure assembly 14 to provide rotational support/positioning to shroud 10. Flexure 22 allows a first flexure assembly arm 24 to resiliently contact tab 16 on a first side 26 thereof. First flexure assembly arm 24 may extend from one side 27 of the base 23 of flexure assembly 14 and run parallel to a bottom portion 29 of base 23. A second flexure assembly arm 28 may be provided in flexure assembly 14 to contact tab 16 on a second side 30 thereof. Second flexure assembly arm 28 may extend from a second, opposite side 31 of base 23 and run parallel to bottom portion 29 of base 23.

When assembled as shown in FIG. 2, first flexure assembly arm 24 and second flexure assembly arm 28 may engage tab 16. This engagement allows shroud 10 to be positioned within the flexure assemblies 14 at the time of assembly, thereby providing minimal, for example, zero initial slop during positioning and assembly of shroud 10 in the gas turbine engine.

When disassembled, as shown in FIGS. 3-5, a space S1 may be present between ends 32 of first flexure assembly arm 24 and second flexure assembly arm 28. Flexure 22 may be in communication with first flexure assembly arm 24 to permit first flexure assembly arm 24 to resiliently bend away from space S1 in a direction along the longitudinal axis of first flexure assembly arm 24. In one embodiment of the present invention, first flexure assembly arm 24 and second flexure assembly arm 28 may be formed integrally with base 23 of flexure assembly 14.

Ends 32 of first flexure assembly arm 24 and second flexure assembly arm 28 may have a rounded or actuate shape, for example, as shown in more detail in FIG. 3. In an assembled, non-operating state, a radial spacing s may be present between base 23 of flexure assembly 14 and a top surface 34 of tab 16. During operation, thermal expansion of shroud 10 may result in an increase or decrease in the size of radial spacing s.

Shroud mounting system 12 of the present invention may also provide a means of mounting shroud 10 in the casing 18 of a gas turbine engine (not shown) while minimizing the amount of heat that may pass from shroud 10 to engine casing 18. Flexure assembly 14 may contact shroud 10 at three locations, namely at spring 20, first flexure assembly arm 24, and second flexure assembly arm 28. This limited contact between flexure assembly 14 and shroud 10 may reduce the heat that is passed between shroud 10 and engine casing 18.

Furthermore, an interface 36 may be provided on ends of first flexure assembly arm 24 and second flexure assembly arm 28. The material chosen for interface 36 may provide material compatibility between first and second flexure assembly arms 24, 28 and tab 16, while also assisting in the thermal protection of engine casing 18 by minimizing the amount of heat that may pass from shroud 10 to engine casing 18. With respect to material compatibility, interface 36 may be made of a material that interacts and tolerates the material of both flexure assembly 14 and shroud 10. Shroud 10 may be made of any material conventional to shrouds in general. For example, shroud 10 may be metallic or ceramic. Flexure assembly 14 may be made of any suitable material, such as Inconel® 718 or Waspaloy™. Interface 36 may be made of a material that interacts with and tolerates the materials of both shroud 10 and flexure assembly 14, for example, a cobalt alloy, such as Haines 188, or a conventional thermal barrier coating.

Figure 6:
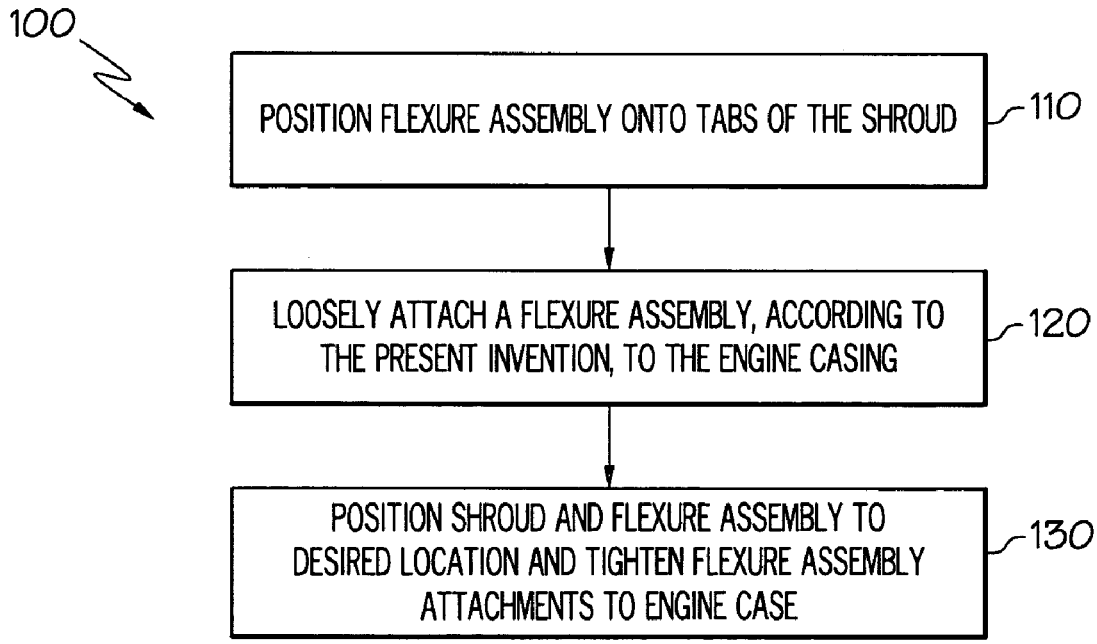
FIG. 6 is a flow chart showing a method for allowing differential radial thermal expansion between an engine casing and a turbine shroud attached thereto, according to one embodiment of the present invention.

Referring to FIG. 6, there is shown one embodiment of a method 100 for mounting a shroud in a gas turbine engine, according to the present invention. Step 110 may include attaching a flexure assembly 14 onto tabs 16 of shroud 10, wherein the flexure assembly may have various elements and characteristics as described above. Step 120 may include positioning the flexure and shroud assembly 12 to the desired location in the engine case. Step 130 may include tightening the attachments between the engine case and the flexure assembly at locations(s) 40 to secure the shroud to the engine case. In step 110, first flexure assembly arm 24 and second flexure assembly arm 28 may engage first end 26 and second end 30, respectively, of tab 16. Flexure assembly 14 may be positioned so that spring 20 contacts a front surface 38 of tab 16. As an example, each flexure assembly may be affixed to the engine casing by passing a fastener, such as a bolt or stud (not shown) or other attachment apparatus, through bores 40 in flexure assembly 14. By means of the above steps, the shroud 10 may be mounted in the gas turbine engine without looseness between the flexure assembly 14 and shroud 10. Moreover, the shroud 10 may be mounted in the gas turbine engine in such a manner to allow for radial and axial movement of shroud 10, especially for the radial movement of shroud 10 due to differential thermal expansion between shroud 10 and engine casing 18.

While the present invention has been described for the positioning of a shroud in a gas turbine engine, the flexure assemblies of the present may be useful in the positioning of a first component or part to a second part of an apparatus, such as an engine, e.g., a liner in a gas turbine engine.

It should be understood, of course, that the foregoing relates to exemplary embodiments of the invention and that modifications may be made without departing from the spirit and scope of the invention as set forth in the following claims.

We claim:

1. A flexure assembly comprising:

a base;

a first arm extending from a first side of the base and running adjacent to and spaced from a bottom of the base;

a second arm extending from a second, opposite side of the base and running adjacent to and spaced from the bottom of the base;

ends of the first arm and second arm each having an interface thereon and defining a space between the ends of the first and second arm; and a spring affixed to a surface of the base, wherein the spring is capable of providing a first resilient force to an object in the space;

wherein the first arm and the second arm are capable of providing a second resilient force to the object in the space; and wherein the interface is a cobalt-based alloy.

2. The flexure assembly according to claim 1, wherein the ends of the first arm and the second arm have an actuate shape.

3. The flexure assembly according to claim 1, wherein the first arm and the second arm are formed integrally with the base.

4. The flexure assembly according to claim 1, further comprising a flexure formed in the base, wherein the flexure is in communication with the first arm and permits the first arm to resiliently bend away from the space.

5. The flexure assembly according to claim 1, wherein a radial space is formed between the bottom of the base and atop surface of each of the first arm and the second arm.

6. A mounting system for attaching a first part to a second part comprising:

at least three tabs on the first part;

at least three flexure assemblies attachable to the second part, each flexure assembly configured to be attached to a corresponding tab, and each flexure assembly comprising a base, a first arm extending from a first side and running adjacent to and spaced from a bottom of the base, a second arm extending from a second, opposite side and running adjacent to and spaced from the bottom of the base, ends of the first arm and the second arm having a space therebetween, and a spring fixed to a surface of the base;

wherein when each tab is placed in the space of the corresponding flexure assembly, the spring of the corresponding flexure assembly provides a resilient force to the corresponding tab; and wherein when each tab is placed in the space of the corresponding flexure assembly the first arm and the second arm of the corresponding flexure assembly provide a resilient force to a first side and a second side of the corresponding tab.

7. The mounting system according to claim 6, wherein, in each of the flexure assemblies, the first arm and the second arm are formed integrally with the base.

8. The mounting system according to claim 6, wherein the ends of the first arm and the second arm of each of the flexure assemblies have an interface thereon.

9. The mounting system according to claim 6, wherein each flexure assembly further comprises a flexure formed in the base of such flexure assembly, wherein the flexure of each flexure assembly permits the first arm of such flexure assembly to resiliently bend away from the corresponding tab in a direction along the longitudinal axis of the first arm of such flexure assembly.

10. The mounting system according to claim 6, wherein a radial space is formed between the bottom of the base and a top of each of the first arm and the second arm of each of the flexure assemblies.

11. The mounting system according to claim 6, wherein the first part is a turbine shroud and the second part is an engine casing.

12. A shroud mounting system for attaching a turbine shroud to an engine casing comprising:

at least three tabs on the outer circumference of the turbine shroud;

at least three flexure assemblies attachable to the engine casing, each flexure assembly configured to be attached to a corresponding tab, and each flexure assembly comprising a base, a first arm extending from a first side of the base and running parallel to a bottom of the base, a second arm extending from a second, opposite side of the base and running parallel to the bottom of the base, ends of the first arm and the second arm defining a space therebetween, and a spring affixed to a surface of the base;

wherein when each tab is placed in the space of the corresponding flexure assembly, the spring in the corresponding flexure assembly provides a resilient force to the corresponding tab; and wherein when the corresponding tab is placed in the space of the corresponding flexure assembly, the first arm and the second arm of the corresponding flexure assembly are capable of providing a resilient force to a first side and a second side of the corresponding tab.

13. The shroud mounting system according to claim 12, wherein the tabs are equally spaced about the circumference of the shroud.

14. The shroud mounting system according to claim 12, wherein, in each of the flexure assemblies, the ends of the first arm and the second arm have an interface thereon.

15. The shroud mounting system according to claim 12, wherein each flexure assembly further comprises a flexure formed in the base of such flexure assembly, wherein the flexure of each flexure assembly permits the first arm of such flexure assembly to resiliently bend away from the corresponding tab along a longitudinal axis of the first arm of such flexure assembly.

16. The shroud mounting system according to claim 12, wherein a radial space is formed between the bottom of the base and a top of each of the first arm and the second arm of each of the flexure assemblies, the radial space permitting radial movement of the shroud relative to the engine casing.

17. The shroud mounting system according to claim 12, wherein the turbine shroud is a component of a gas turbine engine.

18. A shroud mounting system for attaching a turbine shroud to an engine casing of a gas turbine engine comprising:

at least three tabs equally spaced about a circumference of the turbine shroud;

at least three flexure assemblies attachable to the engine casing, each flexure assembly comprising a base, a first arm formed integrally with and extending from a first side of the base and running parallel to a bottom of the base, a second arm formed integrally with and extending from a second, opposite side of the base and running parallel to the bottom of the base, ends of the first arm and the second arm having a space therebetween, and a spring affixed to a surface of the base, and each of the flexure assemblies adapted for attachment to a corresponding tab;

the ends of the first arm and the second arm of each of the flexure assemblies have an actuate shape;

a flexure formed in the base of each of the flexure assemblies, wherein the flexure permits the first arm to resiliently bend away from the tab along a longitudinal axis of the first assembly arm;

at least one bore in the base of each of the flexure assemblies, the bore adapted for affixing the flexure assembly to the engine casing; and a radial space formed between the bottom of the base and a top of each of the first arm and the second arm of each of the flexure assemblies, the radial space permitting radial movement of the shroud relative to the engine casing;

wherein when each tab is placed in the space of the corresponding flexure assembly, the spring of the corresponding flexure assembly provides a resilient force to the corresponding tab; and wherein when each tab is placed in the space of the corresponding flexure assembly, the first arm and the second arm of the corresponding flexure assembly provide a resilient force to a first side and a second side of the corresponding tab.

19. A method for attaching a turbine shroud to an engine casing of a gas turbine engine comprising:

attaching at least three flexure assemblies to the engine casing, each flexure assembly configured to be attached to a corresponding tab, and each flexure assembly comprising a base, a first arm formed integrally with and extending from a first side of the base and running parallel to a bottom of the base, a second arm formed integrally with and extending from a second, opposite side of the base and running parallel to the bottom of the base, ends of the first arm and the second arm having a space therebetween, and a spring affixed to a surface of the base;

equally spacing at least three tabs about a circumference of the turbine shroud;

positioning each of the tabs between the end of the first arm and the end of the second arm of the corresponding flexure assembly; and affixing the base of each of the flexure assemblies to the engine casing.

20. The method according to claim 19, further comprising forming a radial space between the bottom of the base and a top of each of the first arm and the second arm of each of the flexure assemblies, the radial spaces allowing for differential thermal expansion of to turbine shroud relative to the engine casing.

21. The method according to claim 19, further comprising forming a flexure in the base of each of the flexure assemblies, wherein the flexure of each flexure assembly permits the first arm of each flexure assembly to resiliently bend away from the corresponding tab along the longitudinal axis of the first arm of the corresponding flexure assembly.

22. A method for allowing differential radial thermal expansion between an engine casing and a turbine shroud attached thereto, the method comprising:

providing at least three flexure assemblies to the engine casing, each flexure assembly configured to be attached to a corresponding tab, and each flexure assembly comprising a base, a first arm formed integrally with and extending from a first side of the base and running adjacent to and spaced from a bottom of the base, a second arm formed integrally with and extending from a second, opposite side of the base and running adjacent to and spaced from the bottom of the base, ends of the first arm and the second arm having a space therebetween, and a spring affixed to a surface of the base; and positioning each of at least three tabs extending radially from the circumference of the shroud between the end of the first arm and the end of the second arm of the corresponding flexure assembly.

* * * * *